US005300728A

United States Patent [19]

Shimada

[11] Patent Number: 5,300,728

[45] Date of Patent: Apr. 5, 1994

[54] METHOD AND APPARATUS FOR ADJUSTING THE TEMPO OF AUTO-ACCOMPANIMENT TONES AT THE END/BEGINNING OF A BAR FOR AN ELECTRONIC MUSICAL INSTRUMENT

[75] Inventor: Yoshihisa Shimada, Hamamatsu, Japan

[73] Assignee: Kabushiki Kaisha Kawai Gakki Seisakusho, Shizuoka, Japan

[21] Appl. No.: 933,197

[22] Filed: Aug. 21, 1992

[30] Foreign Application Priority Data

Sep. 4, 1991 [JP] Japan ..... 3-253061

[51] Int. Cl.[5] ..... G10H 7/00

[52] U.S. Cl. ..... 84/636; 84/612; 84/652

[58] Field of Search ..... 84/612, 636, 652

[56] References Cited

U.S. PATENT DOCUMENTS 4,345,501 8/1982 Nakada et al. ..... 84/612
4,476,764 10/1984 Nishimoto ..... 84/668
4,887,505 12/1989 Suzuki ..... 84/714
4,991,487 2/1991 Yamaguchi ..... 84/714
5,107,745 4/1992 Utsumi ..... 84/612
5,164,529 11/1992 Saito ..... 84/612
5,220,120 6/1993 Mukaino ..... 84/636
5,221,801 6/1993 Bruti et al. ..... 84/612

*Primary Examiner*—William M. Shoop, Jr.
*Assistant Examiner*—Jeffrey W. Donels

[57] ABSTRACT

This invention discloses an electronic musical instrument incorporating an auto-accompaniment apparatus, which can desirably set a tempo of rhythm accompaniment tones (e.g., chord, bass, and drum accompaniment tones) using a tempo preset button or an increment-/decrement button during a play operation. The read speed of an auto-accompaniment data memory is determined on the basis of the set tempo. A tempo controller for switching from the current tempo to a new tempo upon detection of a division of a bar of auto-accompaniment data is arranged, thereby eliminating uneasy feeling upon switching of tempo.

5 Claims, 7 Drawing Sheets

METHOD AND APPARATUS FOR ADJUSTING THE TEMPO OF AUTO-ACCOMPANIMENT TONES AT THE END/BEGINNING OF A BAR FOR AN ELECTRONIC MUSICAL INSTRUMENT

BACKGROUND OF THE INVENTION

1. Field of the Invention

The present invention relates to a tempo setting apparatus and, more particularly, to a tempo setting apparatus suitably used in an electronic keyboard having auto-play functions such as a rhythm play function, a chord play function, and the like.

2. Description of the Related Art

An electronic keyboard (e.g., an electronic piano) has auto-accompaniment functions such as a rhythm auto-accompaniment function, and a chord auto-accompaniment function, where auto-accompaniment tones for one to four bars are repetitively played on the basis of auto-play data for rhythm tones, chord tones, and the like stored in, e.g., a ROM.

In an electronic keyboard, or the like, an auto-play tempo for chord tones can be desirably set (incremented/decremented) by a tempo setting button on an operation panel.

Auto-play data includes standard preset tempo data in units of rhythms. When a preset tempo button on the operation panel is depressed during an auto-play operation, the auto-play operation is performed in a standard preset tempo corresponding to the selected rhythm.

When a player sets a preset tempo corresponding to a rhythm while an auto-play operation of rhythm tones or chord tones is performed in a free tempo set by the player, the tempo of the music piece being auto-played abruptly changes in the middle of a bar, and the player feels uneasy in terms of the progress of the music piece.

When the tempo is changed using the tempo setting button during an auto-play operation, the tempo abruptly changes in the middle of a bar in the same manner as described above, resulting in uneasy feeling.

Therefore, when the tempo is changed during a play operation, an auto-play operation must be temporarily stopped, the tempo is changed, and thereafter, the auto-play operation is restarted, thus requiring cumbersome operations.

SUMMARY OF THE INVENTION

It is an object of the present invention to provide an auto-accompaniment apparatus which can change the tempo at the beginning of a bar next to the bar in which a preset tempo corresponding to a rhythm is set.

An auto-accompaniment apparatus of the present invention comprises an auto-play data memory for storing auto-accompaniment data in correspondence with rhythms in units of bars, a tone generator for reading out tone generation waveform data from a waveform ROM on the basis of auto-accompaniment data read out from the auto-play data memory, and outputting the readout waveform data as tone signals, tempo setting operation means for setting a tempo for reading out auto-accompaniment data from the auto-play data memory, and a tempo controller for, when data of a bar timing in the auto-accompaniment data is detected after a tempo setting operation is performed, changing a current tempo into the tempo set by the tempo setting operation means.

According to another characteristic feature of the present invention, the tempo setting operation means comprises a preset tempo button for setting tempo data in auto-accompaniment data.

According to still another characteristic feature of the present invention, the tempo setting operation means comprises an increment/decrement button for incrementing/decrementing the tempo.

When a tempo setting operation member is depressed during an auto-play operation, a tempo being played is not changed immediately but the tempo is changed when the play operation reaches the beginning of a new bar so as to continue the play operation, thus eliminating uneasy feeling in the progress of a music piece.

DETAILED DESCRIPTION OF THE PREFERRED EMBODIMENT

Figure 1:
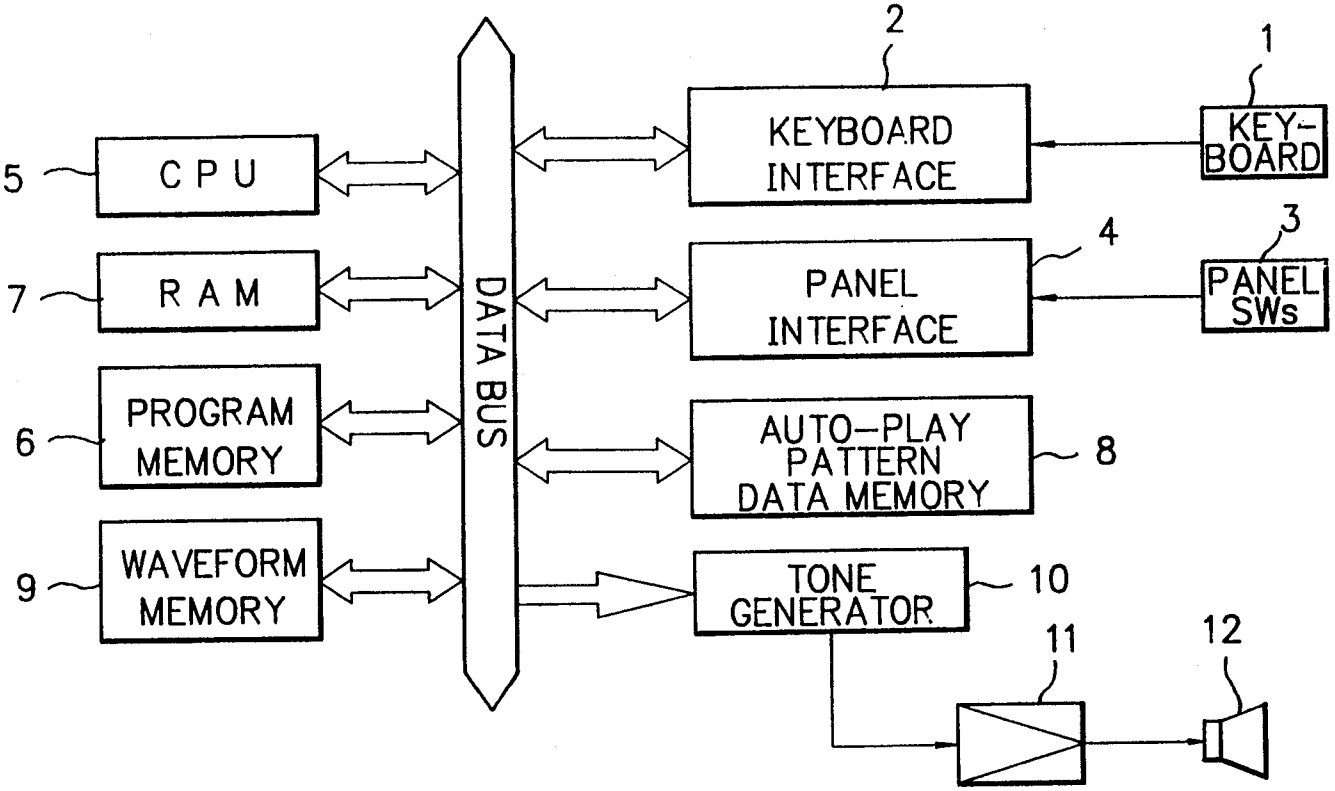
FIG. 1 is a block diagram of an electronic musical instrument according to an embodiment of a tempo setting apparatus of the present invention.

FIG. 1 is a block diagram of an electronic musical instrument according to an embodiment of a tempo setting apparatus of the present invention. This electronic musical instrument includes a keyboard 1 and panel switches 3. The keyboard 1 and the panel switches 3 are connected to a data bus respectively through a keyboard interface 2 and a panel interface 4.

A circuit portion of the electronic musical instrument includes a microcomputer consisting of a CPU 5, a program memory 6, and a RAM 7, which are connected to each other through the data bus. The CPU 5 detects operation information of the keyboard 1 from the keyboard interface 2 connected to the keyboard 1, and also detects operation information of the panel switches 3 from the panel interface 4 connected to the panel switches 3. The CPU 5 supplies, to a tone generator 10, note information corresponding to the operation of the keyboard 1, and parameter information such as a rhythm, a tone color, and the like corresponding to the operation of the panel switches 3.

The tone generator 10 reads out PCM tone source data SP from a waveform memory 9 on the basis of these pieces of information, processes the amplitude and envelope of the readout data, and outputs the processed data to a D/A converter (not shown). The digitized tone signals are then supplied to a loudspeaker 12 through an amplifier 11.

An auto-play pattern data memory 8 stores auto-accompaniment data. The CPU 5 reads out auto-accompaniment data corresponding to operation of a given panel switch from the auto-play pattern data memory 8, and supplies the readout data to the tone generator 10. Upon reception of the auto-accompaniment data, the tone generator 10 reads out corresponding waveform data of, e.g., chord, bass, and drum tones from the waveform memory 9, and outputs the readout data to the D/A converter. Therefore, auto-accompaniment chord, bass, and drum tones can be obtained from the loudspeaker 12 in addition to tones corresponding to the operation of the keyboard 1.

Figure 2:
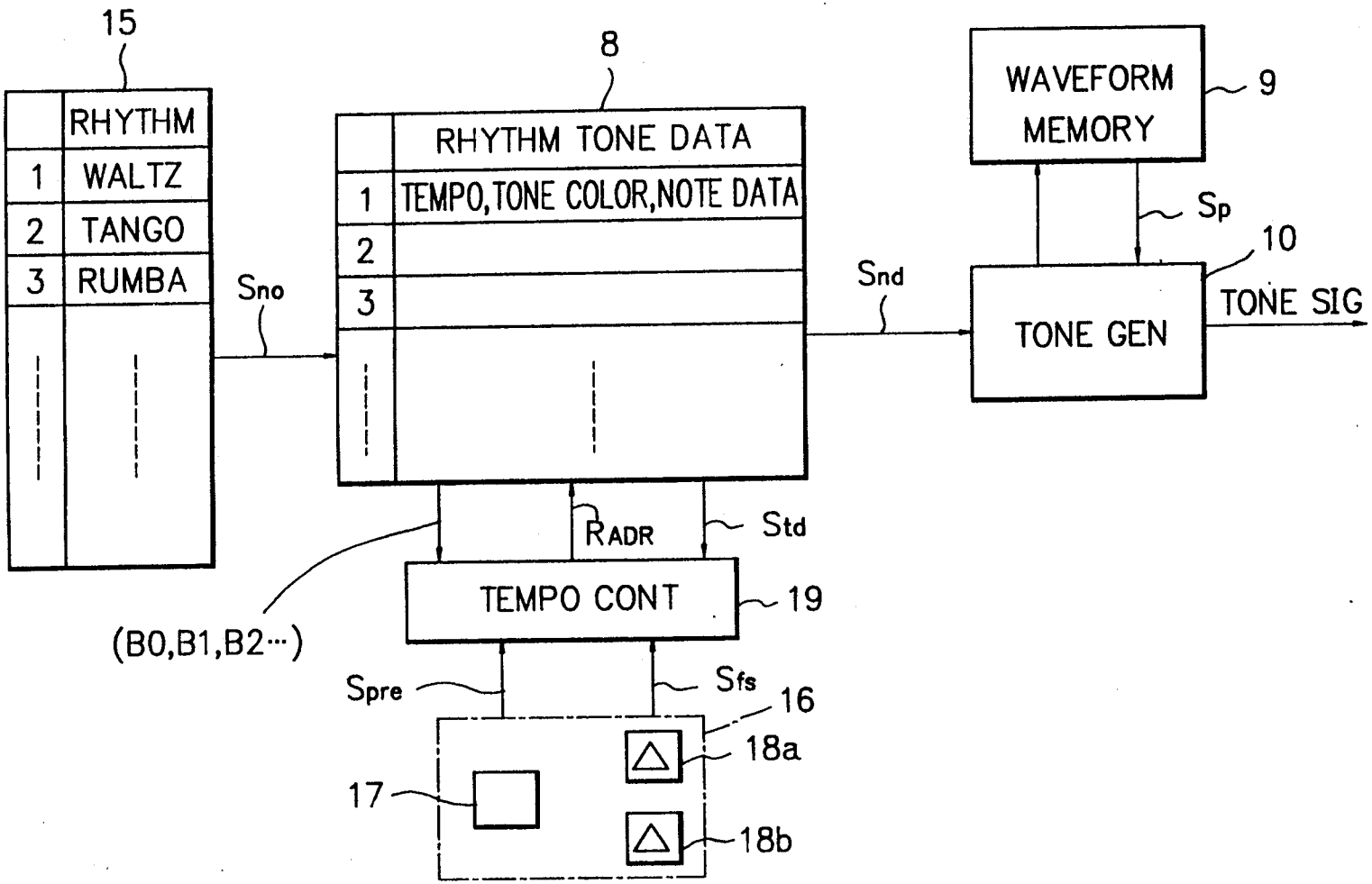
FIG. 2 is a principal part block diagram showing elemental features of the present invention.

FIG. 2 is a block diagram showing elemental features of the present invention. A rhythm selector 15 key switches arranged on an operation panel. The operation panel is also provided with a tempo setting operation apparatus 16 for setting a tempo for reading out auto-accompaniment data from the auto-play pattern data memory 8. Buttons for setting a tempo such as a preset tempo button 17, tempo increment/decrement buttons 18*a* and 18*b*, and the like are arranged on the tempo setting operation apparatus 16.

As shown in FIG. 2, the auto-play pattern data memory 8 stores various data such as tempo data tone color data, note data, and the like, and includes tables for storing note data strings for auto-accompaniment tones such as chord tones, bass tones, and drum tones, in units of rhythms. Each note data consists of key (pitch) number data, tone generation timing data, tone generation duration data, tone volume data, and the like. Note data Snd selected based on a rhythm number signal Sno supplied from the rhythm selector 15 is supplied to the tone generator 10, and tempo data Std is supplied to a tempo controller 19. The tempo controller 19 includes a CPU, and receives a preset tempo signal Spre, a tempo increment/decrement signal Sfs, from the tempo setting operation means 16.

The tempo controller 19 generates tempo clocks in a tempo, which is set based on the preset tempo signal Spre, the tempo increment/decrement signal Sfs, and the like supplied from the tempo setting operation apparatus. 16, and outputs read addresses $R_{ADR}$ on the basis of the tempo clocks to the auto-play pattern data memory 8. Tone color data and note data Snd of rhythm and chord tones read out from the auto-play pattern data memory 8 are supplied to the tone generator 10, thus forming tone signals for rhythm and chord accompaniment tones.

Data B0, B1, B2, . . . (indicating bar timings (ends of bars) in note data read out from the auto-play pattern data memory 8) are supplied to the tempo controller 19. When a tempo change operation is made, as will be described later, the tempo controller 19 changes the frequency of the tempo clocks, i.e., the tempo at the beginning of a new bar with reference to these bar timing data.

Figure 3:
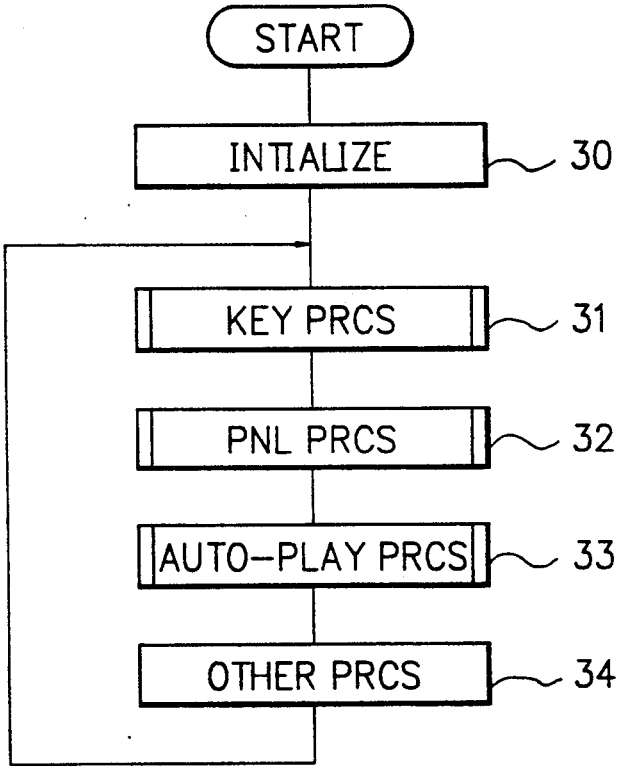
FIG. 3 is a flow chart showing main processing of a CPU.

FIG. 3 is a flow chart for explaining details of main processing. When the power switch of this electronic keyboard instrument is turned on, initialization processing is performed in step 30. In this step, a sound source is initialized, the RAM is cleared, and so on. In step 31, key scan processing for sequentially checking operation states of all the keys on the keyboard 1 is executed. If a key operation (key depression or key release) is detected, tone-ON/tone-OFF processing corresponding to the key operation is performed.

In step 32, panel processing is executed to sequentially check the operation states of all the panel switches 3 on the operation panel, and processing according to the operation of the panel switch is performed. Thereafter, the flow advances to step 33 to execute auto-play processing. In step 34, other processing operations are executed.

Figure 4:
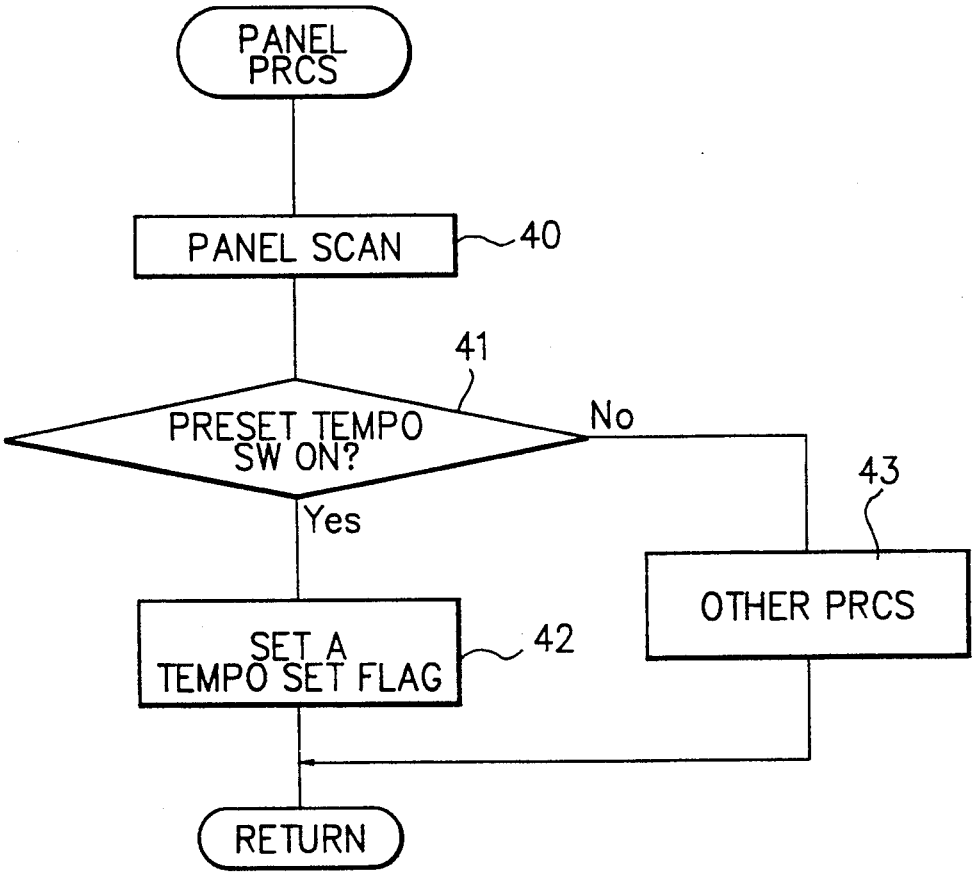
FIG. 4 is a flow chart showing a content of panel processing.

FIG. 4 is a flow chart showing the contents of the panel processing in step 32 in the main processing shown in FIG. 3. In step 40, scan processing is executed. In step 41, it is checked if the preset tempo switch is ON. If YES in step 41, the flow advances to step 42, and a tempo set flag is set. If it is determined in step 41 that the preset tempo switch is not ON, the flow advances to step 43 to execute other processing operations.

Figure 5:
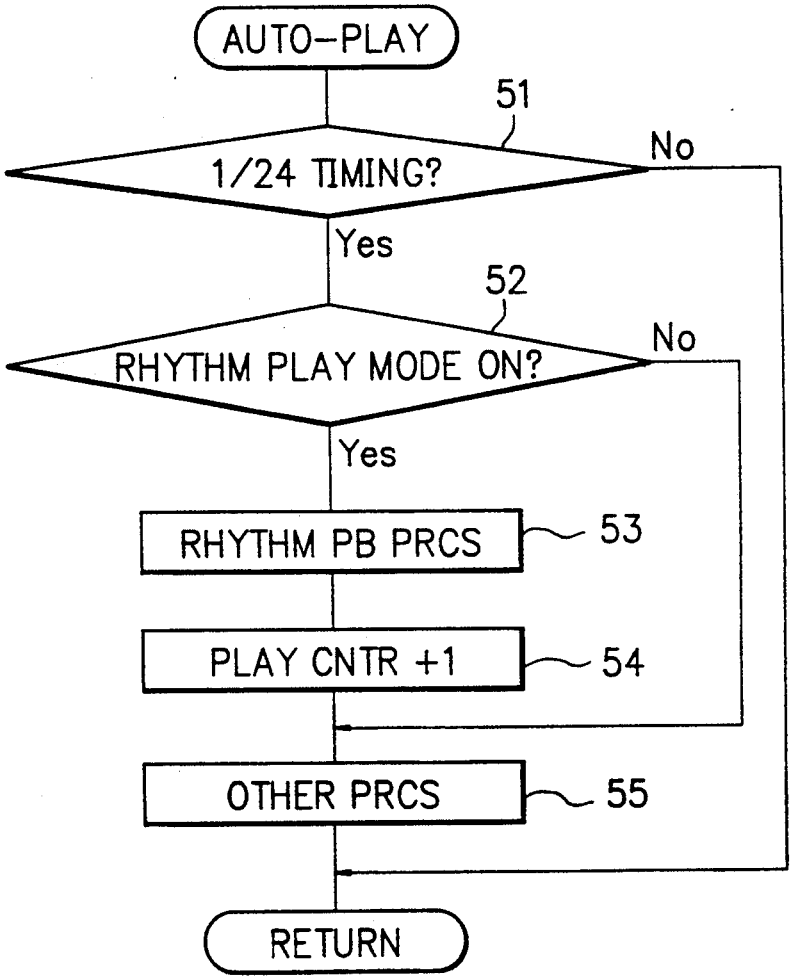
FIG. 5 is a flow chart showing processing executed when play data is played back.

FIG. 5 shows processing steps executed when play data is replayed from memory. In step 51, of a timing 1/24 a quarternote (96 clocks=timing corresponding to clocks per bar) is detected. If the timing is detected, the flow advances to step 52 to check if a rhythm play mode is ON.

If NO in step 52, the flow jumps to step 55 to execute other processing operations, and the control returns to the main routine. However, if it is determined in step 52 that the rhythm play mode is ON, the flow advances to step 53, and rhythm playback (PB) processing is executed. The flow then advances to step 54, and the count value of a play counter is incremented by 1. Thereafter, the flow advances to step 55 to execute other processing operations.

Figure 6:
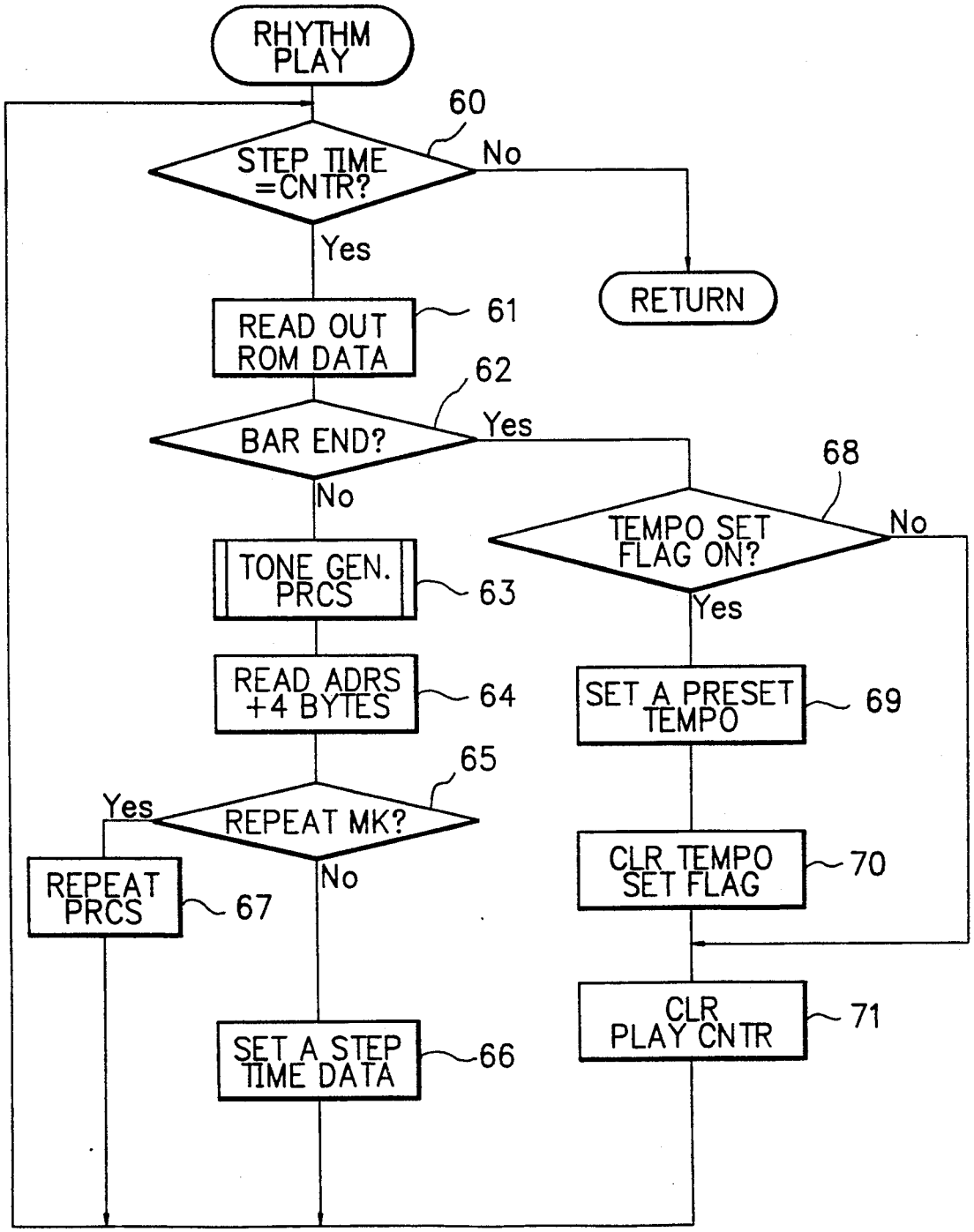
FIG. 6 is a flow chart showing rhythm play processing.

FIG. 6 shows rhythm play (playback) processing. In this case, it is checked in step 60 if the count value of a time-base counter coincides with step time data in note data of, e.g., a rhythm tone. If YES in step 60, the flow advances to step 61 to set a read address, thereby reading out a 4-byte note data from the auto-play pattern data memory 8. However, if NO is determined in step 60, control returns to the main routine.

After step b1, it is then checked in step 62 if the readout note data indicates the end of a bar. If NO in step 62, the flow advances to step 63 to execute tone generation processing. In step 64, the read address is advanced by 4. In step 65, it is checked if the next note data is a repeat mark. If NO in step 65, step time data of the next note is set in step 66, and control returns to the main routine. However, if YES in step 65, repeat processing is executed in step 67, and thereafter, the control returns to the main routine.

If it is determined in step 62 that the readout note data indicates the end of a bar, the flow advances to step 68 to check if the tempo set flag is ON. If NO in step 68, the flow jumps to step 71 to clear the play counter.

However, if YES in step 68, preset tempo data of the corresponding rhythm of the auto-play pattern data memory 8 is set in the tempo controller 19 in step 69. In step 70, the tempo set flag is cleared, and the flow then advances to step 71.

Figure 7:
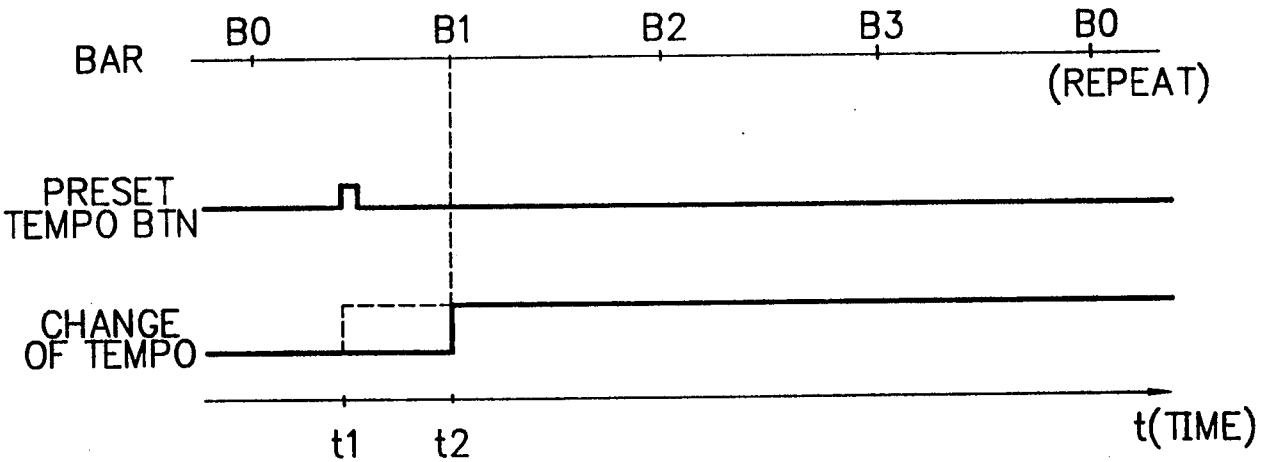
FIG. 7 is a timing chart showing timings when the tempo is changed.

Since the auto-accompaniment apparatus of this embodiment sets a tempo, as described above, when the tempo setting switch is depressed during a rhythm play operation to switch the tempo from a free tempo to a standard tempo corresponding to a rhythm during the play operation, the set tempo is started from the beginning of the next bar. More specifically, as shown in the timing chart in FIG. 7, when a preset tempo is to be set, even when the preset tempo button is depressed at time tl, the tempo is not immediately changed. When a play operation reaches the start timing B1 of the next bar at time t2, the tempo is changed. Therefore, the tempo setting apparatus of this embodiment can eliminate the uneasy feeling in the progress of a music piece due to an abrupt change in tempo during a play operation, and allows a smooth tempo setting operation. In the above description, preset tempo data in units of rhythms is set. However, the present invention may be applied to a case wherein a tempo change operation for incrementing/decrementing a free tempo upon depression of the tempo increment/decrement button 18*a* or 18*b* is performed.

As described above, when the tempo setting operation switch is depressed during an auto-play operation, a tempo corresponding to a rhythm is set as a current tempo value when the play operation reaches the beginning of a new bar, thus continuing the play operation. For this reason, uneasy feeling in the progress of a music piece due to an abrupt change in tempo can be prevented. In addition, the tempo can be desirably changed during the play operation without requiring cumbersome operations, e.g., without interrupting an auto-play operation to change the tempo.

What is claimed is:

1. An auto-accompaniment apparatus comprising:

an auto-play data memory means for storing auto-accompaniment data in units of bars, the auto-accompaniment data having different tempo data for different kinds of rhythm;

waveform memory means for storing a plurality of tone generating waveform data corresponding to the auto-accompaniment data stored in said auto-play data memory means;

tone generator means for reading out tone generation waveform data from said waveform memory means on the basis of the auto-accompaniment data read out from said auto-play data memory, and outputting the readout waveform data as tone signals;

tempo setting means for setting a replacement tempo for a current tempo to modify or change a reading speed of the auto-accompaniment data from said auto-play data memory means; and tempo controller means for detecting an end of a bar in the current tempo in response to initiation of said tempo setting means and changing a current tempo to the replacement tempo set by said tempo setting means such that the tempo of the auto-accompaniment data is not changed in the middle of a bar.

2. An auto-accompaniment apparatus according to claim 1, wherein said tempo setting means comprises rhythm selection means for presetting a selected one of the auto-accompaniment data and a preset tempo button for determining the replacement tempo with tempo data contained in said selected one of the auto-accompaniment data.

3. An auto-accompaniment apparatus according to claim 1, wherein said tempo setting means further comprises tempo adjustment means for incrementing/decrementing tempo as set by said tempo setting means.

4. A method for adjusting tempo of auto-accompaniment data comprising:

storing the auto-accompaniment data in units of bars, the auto-accompaniment data having different tempo data for different kinds of rhythm;

storing tone generating waveform data corresponding to the auto-accompaniment data;

reading out the tone generation waveform data based on the auto-accompaniment data, and outputting the readout waveform data as tone signals;

setting a replacement tempo for a current tempo to modify or change a reading speed of the auto-accompaniment data; and after said tempo setting step, detecting an end of a bar in the current tempo using a tempo controller and changing the current tempo into the set replacement tempo such that the tempo of the auto-accompaniment data is not changed in the middle of a bar.

5. The method of claim 4, wherein said tempo setting step includes presetting a selected one of the auto-accompaniment data and determining the replacement tempo with tempo data contained in the selected on of the auto-accompaniment data.

* * * * *